United States Patent [19]

Riikonen

[11] 4,043,570

[45] Aug. 23, 1977

[54] SKI BINDING

[76] Inventor: Pentti Riikonen, Kiverionkatu 12 B48, Lahti, Finland

[21] Appl. No.: 683,042

[22] Filed: May 5, 1976

[30] Foreign Application Priority Data

Mar. 15, 1976 Finland ..... 760671

[51] Int. Cl.[2] ..... A63C 9/20

[52] U.S. Cl. ..... 280/615

[58] Field of Search ..... 280/614, 615, 618, 633, 280/635, 621

[56] References Cited

U.S. PATENT DOCUMENTS

| | | | |
|---|---|---|---|
| 3,715,127 | 2/1973 | With | 280/615 |

FOREIGN PATENT DOCUMENTS

| | | | |
|---|---|---|---|
| 2,504,304 | 8/1975 | Germany | 280/615 |
| 115,895 | 12/1968 | Norway | 280/615 |
| 83,367 | 3/1935 | Sweden | 280/615 |
| 215,775 | 7/1968 | U.S.S.R. | 280/615 |

*Primary Examiner*—Joseph F. Peters, Jr.
*Assistant Examiner*—David M. Mitchell
*Attorney, Agent, or Firm*—Toren, McGeady and Stanger

[57] ABSTRACT

A ski binding of the toe fastening type is disclosed having a one-piece integral toe part. The toe part has a foot plate with holes for fixing screws to attach the binding to a ski and has lugss located on either side of the toe part. A forwardly directed clamping yoke has arms which are journaled in the lugs and can be elastically urged against the upper surface of a sole welt of the boot of a user and can be secured against the welt with the aid of a locking member carried on a continuation portion of the toe part. The continuation portion of the toe part has side walls which extend in a downward direction so that the locking member is positioned in the continuation portion against bearing surfaces in the upward and sideward directions.

4 Claims, 3 Drawing Figures

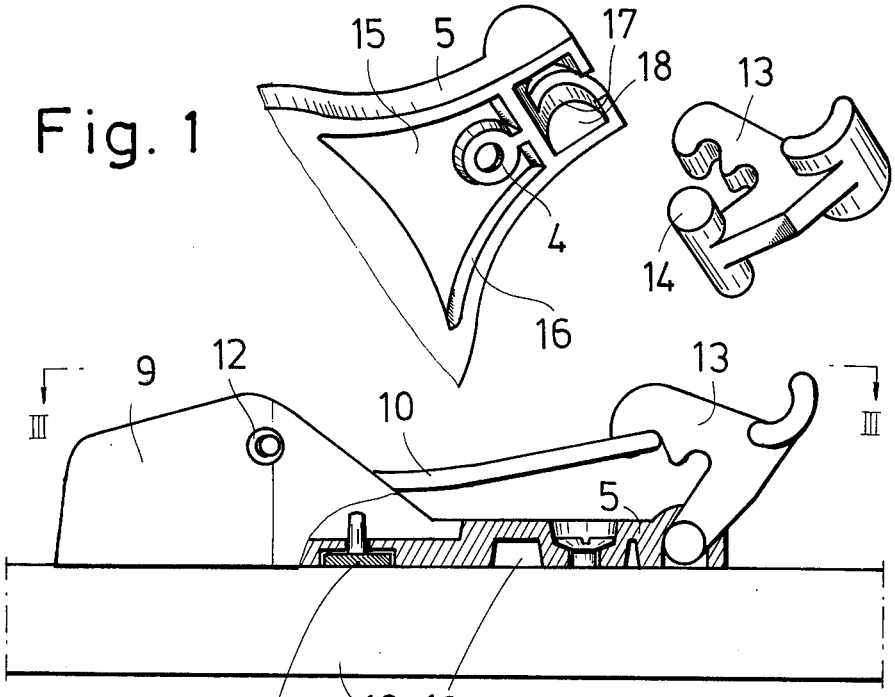
Fig. 1
Fig. 2
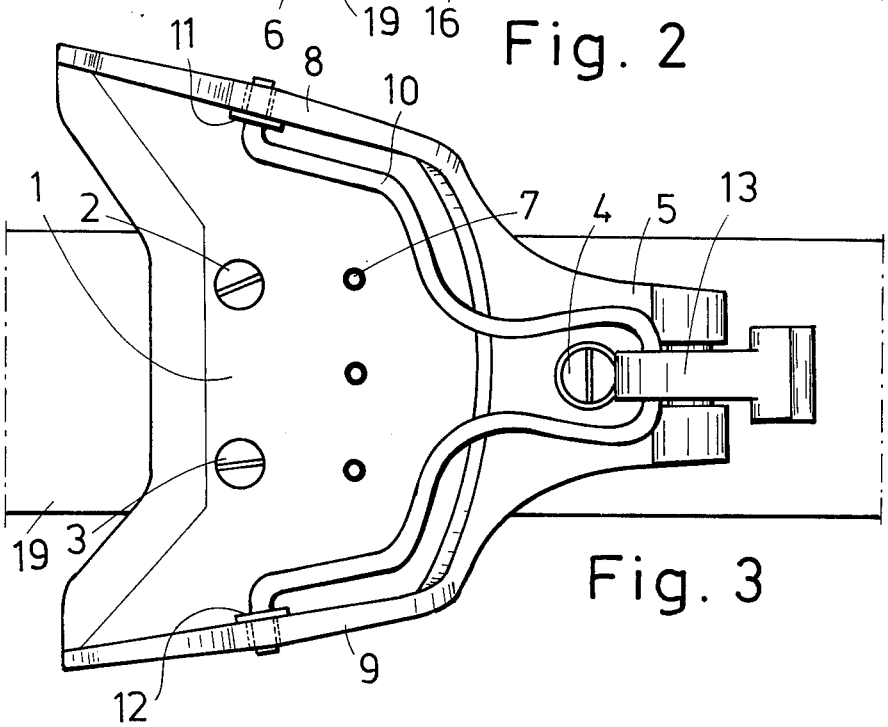
Fig. 3

SKI BINDING

BACKGROUND OF THE INVENTION

The ski bindings known in the prior art are usually made of sheet metal, such as aluminium for instance. They have a toe part bent into shape by pressing and to the continuation portion of which a locking member made from sheet material by bending has been attached by riveting. The manufacturing of a ski binding of this type includes several expensive work steps. It is also a fact that a large amount of snow accumulates quite unnecessarily on a ski binding having upwardly bent side parts on the extension of its toe part.

SUMMARY OF THE INVENTION

The object of the present invention is to eliminate the drawbacks mentioned. The ski binding of the invention is characterized in that the continuation portion of the toe part has downwardly formed side parts so that the locking member has, in the continuation of the toe part, bearing faces in the upward and sideward directions. A specific embodiment of the invention is characterized in that the locking member and the journalling axle constitute one single piece.

In the ski binding of the invention the locking member is a separate, detached part. This locking member becomes fixed in the ski binding when the binding is screwed on the ski. Since the side parts of the toe part in the continuation are downwardly directed, this continuation of the toe part has no confined part on its sides which would accumulate snow.

BRIEF DESCRIPTION OF THE DRAWINGS

The invention is now described, with reference to the attached drawing, wherein:

FIG. 1 presents the continuation portion of the toe part of the ski binding and the locking member, both in exploded relationship by themselves and viewed obliquely from below.

FIG. 2 shows the ski binding in elevational view and partly sectioned, as attached to a ski.

FIG. 3 shows the same ski binding in top view, viewed in the direction of the arrows III—III.

DESCRIPTION OF THE INVENTION

The ski fastening of the invention may be made e.g. of plastic in a casting precess, whereby this structure is very light. The foot plate 1 of the ski binding carries two fixing screws 2, 3 and the continuation of the toe part, 5, carries one screw 4. Under the foot plate there may be a metal plate 6 countersunk in the foot plate 1 and e.g. of rectangular shape, carrying cast or riveted, upwardly directed spikes 7, which pass through the foot plate and are meant to engage with the lower surface of the shoe sole. The lugs 8, 9 of the ski binding carry bearing bushes 11, 12, either cast in place or detached bushings. The clamping yoke 10 has its arms journaled in bushes 11, 12. The locking member 13 and the journalling axle 14 are integral in one piece, and the continuation portion 5 of the toe part has downwardly formed side parts 15, 16 so that for the locking member 13, 14 there have been provided, in the upward and sideward directions, the bearing surfaces 17, 18. The locking member 13, 14 may have one or several locking positions.

In connection with the attaching of the ski binding the locking member 13, 14 is mounted in the bearing part intended for it, which is found in the continuation portion 5 of the toe part. After the ski binding has been fixed on the ski 19, the locking member is turnably held in the continuation portion 5 of the toe part. The toe part 5 also has downwardly shaped side parts 15, 16, whereby the top surface of this continuation 5 is smooth and collects no snow.

It is obvious to one skilled in the art that different embodiments of the invention may vary within the scope of the claims following below.

I claim:

1. A ski binding comprising a one-piece toe part having a foot plate, screw holes formed in said foot plate for screws to attach the binding to a ski, a pair of lugs positioned on either side of said toe part, a bushing carried by each of said lugs, a forwardly directed clamping yoke having arms journaled in each of said bushings so as to be elastically urged against the upper surface of a welt of a sole of a boot to be clampingly held in said binding, a continuation portion extending from said toe part, said continuation portion having downwardly extending side walls and a top cover forming a downwardly open recess closed by the upper surface of the ski, said top cover having an opening, and a locking member having a journaling axle formed integral therewith pivotally carried in said downwardly open recess of said continuation portion and having means extending through said opening normal to said axle for releasably engaging said clamping yoke for locking said yoke against said welt to secure said boot in the binding.

2. An improvement in a ski binding having a one-piece toe part with a foot plate, at least two holes formed in said foot plate for screws to attach the binding to a ski, a pair of upstanding lugs positioned on either side of said toe part, a bush formed in each of said lugs, a forwardly directed clamping yoke having arms journaled in each of said bushes so as to be elastically urged against the upper surface of a welt of a sole of a boot to be clampingly held in said binding, a continuation portion extending from said toe part, and a locking member having a journaling axle pivotally carried in said continuation portion and including means for releasably engaging said clamping yoke for locking said yoke to secure said boot in said binding, wherein the improvement comprises said continuation portion having side and top walls forming a downwardly open recess closed by the upper surface of the ski and carrying therein said journaling axle of said locking member, the top wall including an opening through which the releasably engaging means extends, said recess forming a bearing housing for said axle of said locking member for protection against weathering conditions.

3. The improved ski binding according to claim 2 wherein said releasably engaging means includes a multi-position hook-like configuration for releasably engaging said clamping yoke, and wherein said journaling axle is integrally formed with said hook-like configuration.

4. The improved ski binding according to claim 2 wherein said top wall and side walls of said continuation portion forming said downwardly open recess forms bearing surfaces for said journaling axle of said locking member in the upward and sideward directions.

* * * * *